US006486851B2

(12) United States Patent
Weaver

(10) Patent No.: US 6,486,851 B2
(45) Date of Patent: Nov. 26, 2002

(54) ANTENNA COMPONENTS AND MANUFACTURING METHOD THEREFOR

(75) Inventor: Timothy H. Weaver, Alpharetta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 27 days.

(21) Appl. No.: 09/751,275

(22) Filed: Dec. 29, 2000

(65) Prior Publication Data

US 2002/0084947 A1 Jul. 4, 2002

(51) Int. Cl.[7] ..... H01Q 19/12; H01Q 1/12
(52) U.S. Cl. ..... 343/878; 343/840; 343/880
(58) Field of Search ..... 343/840, 878, 343/781 R, 781 P, 880; H01Q 19/12, 1/12

(56) References Cited

U.S. PATENT DOCUMENTS

| | | | | | |
|---|---|---|---|---|---|
| 4,095,230 | A | * | 6/1978 | Salmond et al. | 343/729 |
| 4,126,865 | A | | 11/1978 | Longhurst et al. | |
| 4,495,706 | A | | 1/1985 | Kaminski | 33/333 |
| 4,626,864 | A | | 12/1986 | Micklethwaite | 343/766 |
| 4,726,259 | A | | 2/1988 | Idler | 74/785 |
| 5,276,972 | A | | 1/1994 | Staney | |
| 5,351,060 | A | | 9/1994 | Bayne | |
| 5,448,254 | A | * | 9/1995 | Schneeman et al. | 343/781 R |
| 5,469,182 | A | | 11/1995 | Chaffee | 343/882 |
| 5,561,433 | A | | 10/1996 | Chaney et al. | 342/359 |
| 5,646,638 | A | | 7/1997 | Winegard et al. | |
| 5,647,134 | A | | 7/1997 | Chou | |
| 5,760,739 | A | | 6/1998 | Pauli | |
| 5,829,121 | A | | 11/1998 | Shoemaker et al. | |
| 5,870,059 | A | | 2/1999 | Reynolds | |
| 5,894,674 | A | | 4/1999 | Feldman | |
| 5,903,237 | A | | 5/1999 | Crosby et al. | 342/359 |
| 5,933,123 | A | * | 8/1999 | Kaul | 343/879 |
| D413,603 | S | | 9/1999 | Inoue | 343/882 |
| 5,977,922 | A | | 11/1999 | Hemmingsen, II | 343/760 |
| 5,999,139 | A | | 12/1999 | Benjamin et al. | |
| 6,023,247 | A | | 2/2000 | Rodeffer | |
| 6,188,372 | B1 | | 2/2001 | Jackson et al. | |
| 6,208,314 | B1 | | 3/2001 | Bourquin | |
| 6,331,839 | B1 | * | 12/2001 | Grenell | 343/840 |

OTHER PUBLICATIONS

Photograph of antenna and mounting bracket, manufactured by Channel Master Company and believed to have been publicly available more than one year prior to the filing date of the subject application.

* cited by examiner

*Primary Examiner*—Hoanganh Le
(74) *Attorney, Agent, or Firm*—Kirkpatrick & Lockhart LLP

(57) ABSTRACT

A support arm arrangement or assembly for a satellite antenna and manufacturing method therefor. In one embodiment, the support arm arrangement includes a hollow support arm having a front end and a real attachment end is affixed to the antenna reflector adjacent is perimeter. A mounting arm may be attached to the rear surface of the reflector or, in another embodiment, the mounting arm comprises an integral portion of the support arm. A feed/LNBF assembly is supported with the front end of the support arm. The feed/LNBF assembly may be electronically coupled to a set top box by a cable that is passed through the hollow support arm and the hollow mounting arm. Methods of constructing support arm assemblies for satellite antennas are also disclosed.

42 Claims, 20 Drawing Sheets

ANTENNA COMPONENTS AND MANUFACTURING METHOD THEREFOR

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to satellite antennas and methods of manufacturing satellite antennas and their components.

2. Description of the Invention Background

The advent of the television can be traced as far back to the end of the nineteenth century and beginning of the twentieth century. However, it wasn't until 1923 and 1924, when Vladimir Kosma Zworkykin invented the iconoscope, a device that permitted pictures to be electronically broken down into hundreds of thousands of components for transmission, and the kinescope, a television signal receiver, did the concept of television become a reality. Zworkykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted over terrestrial broadcast networks and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc. and operate using broader frequency ranges, such signals typically offer the viewer more viewing options and improved picture quality. Thus, companies have found offering satellite television services to be very profitable and, therefore, it is anticipated that more and more satellites will be placed in orbit in the years to come.

Modern digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a directional receiver antenna. Such antennas are commonly affixed to the roof or wall of the subscriber's residence or are mounted to a tree or mast located in the subscriber's yard. A typical antenna constructed to receive satellite signals comprises a dish-shaped reflector that has a feed support arm protruding outward from the front surface of the reflector. The feed support arm supports a feed/LNBF assembly in the form of a low noise block amplifier with an integrated feed "LNBF". The reflector collects and focuses the satellite signal onto the LNBF which is connected, via cable, to the subscriber's television.

Such prior antennas are not particularly aesthetically appealing. They commonly include a feed support arm that are fabricated from metal tubing or the like which is susceptible to corrosion. The feed/LNBF assemblies are typically attached to the end of the feed support arm with upstanding posts which can further detract from the antenna's aesthetic appearance. Furthermore, most antenna reflectors are coupled directly to a mounting bracket that also detracts from the antenna's appearance.

There is a need for an antenna that has an appealing aesthetic appearance.

There is another need for antenna that has a support arm that protects the feed/LNBF assembly from the elements and encloses the cables that are attached to the feed/LNBF assembly.

There is yet another need for a method of efficiently and economically manufacturing an antenna with the above-mentioned attributes.

SUMMARY OF THE INVENTION

In accordance with one form of the present invention, there is provided a support arm arrangement for an antenna that has a parabolic reflector that has a perimeter, a front surface and a rear surface. The support arm arrangement of this embodiment also includes a hollow feed support arm that has an attachment portion and a front portion. The feed support arm has a front flange that covers a point of attachment wherein the attachment portion is attached to the perimeter of the parabolic reflector. The attachment portion is attached to the perimeter of the reflector. A reflector mounting arm is attached to the rear surface of the reflector.

Another embodiment of the present invention comprises a support arm arrangement or assembly for an antenna that has a molded parabolic reflector that has a front surface, a rear surface, and a perimeter. This embodiment includes a molded hollow feed support arm that has a front end and an attachment end. The attachment end is attached to the reflector adjacent to the reflector perimeter. The attachment portion also has a front flange and a bottom flange for covering a point of attachment wherein the feed support arm joins the reflector. A feed/LNBF assembly is supported in the front end of the hollow feed support arm. This embodiment also includes a molded hollow reflector mounting arm that is pivotally affixed to the rear surface of the reflector. A cable extends through the hollow reflector mounting arm and the hollow support arm. The cable is connected to a set top box and the feed/LNBF assembly.

Another embodiment of the present invention comprises support arm assembly for an antenna that has a parabolic reflector that has a perimeter, a front surface and a rear surface. A hollow support arm is attached to the perimeter of the reflector. The hollow support arm has an integral front portion and an integral rear-mounting portion.

Yet another embodiment of the present invention comprises an antenna that includes a parabolic reflector having a perimeter, a front surface and a rear surface. A hollow support arm is attached to the perimeter of the reflector. The hollow support arm further has an integral rear flange for attachment to the rear surface of the reflector. The hollow support arm has an integral front portion and an integral rear-mounting portion. A feed/LNBF assembly is supported in the front end of the hollow support arm. A cable extends through the hollow support arm and is connected to a set top box and the feed/LNBF assembly.

The present invention may also include a method of manufacturing a support arm assembly for an antenna that has a parabolic reflector molded from a first material wherein the parabolic reflector has a front surface, a rear surface, and a perimeter. The method includes molding a hollow support arm from the first material wherein the hollow support arm has a front end and a rear attachment end. The method also includes affixing the rear attachment end of the hollow support arm to reflector at its perimeter thereof and molding a hollow mounting arm. The hollow mounting arm is affixed to the rear surface of the reflector. A feed/LNBF assembly is supported in the front end of the support arm and is electrically coupled to a set top box.

The present invention may also include a method of manufacturing an antenna that comprises molding a parabolic reflector from a first material wherein the parabolic reflector has a front surface, a rear surface, and a perimeter. In addition, a hollow feed support arm is molded from the first material. The hollow feed support arm has a front end, a central attachment portion and a mounting portion. The central attachment portion of the hollow feed support arm is affixed to the reflector at its perimeter. A feed/LNBF assembly is supported in the front end of the support arm and is electrically coupled to a set top box.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
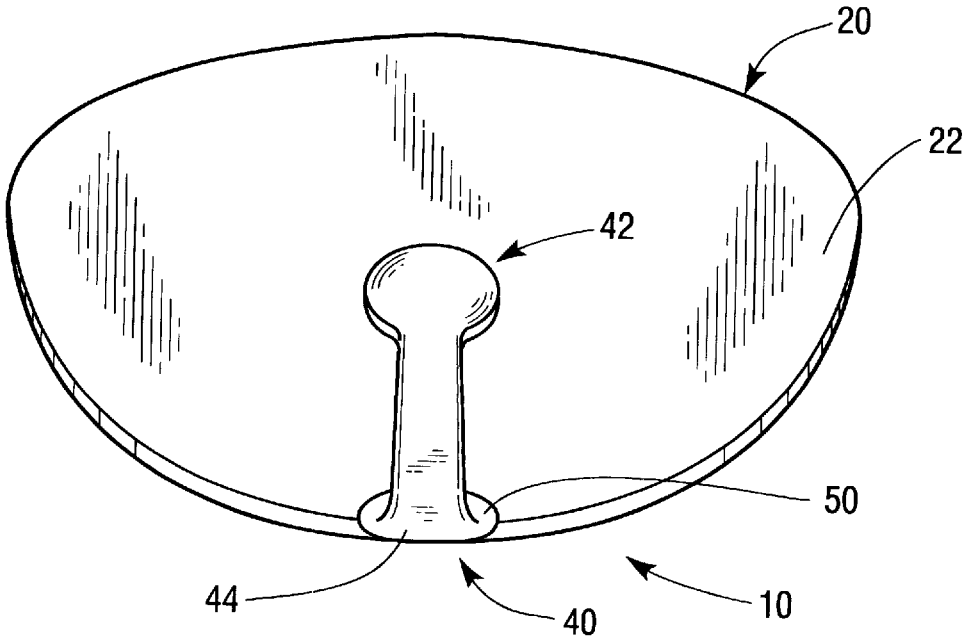
FIG. 1 is a front view of a receiver with one embodiment of the present invention attached thereto.
Figure 2:
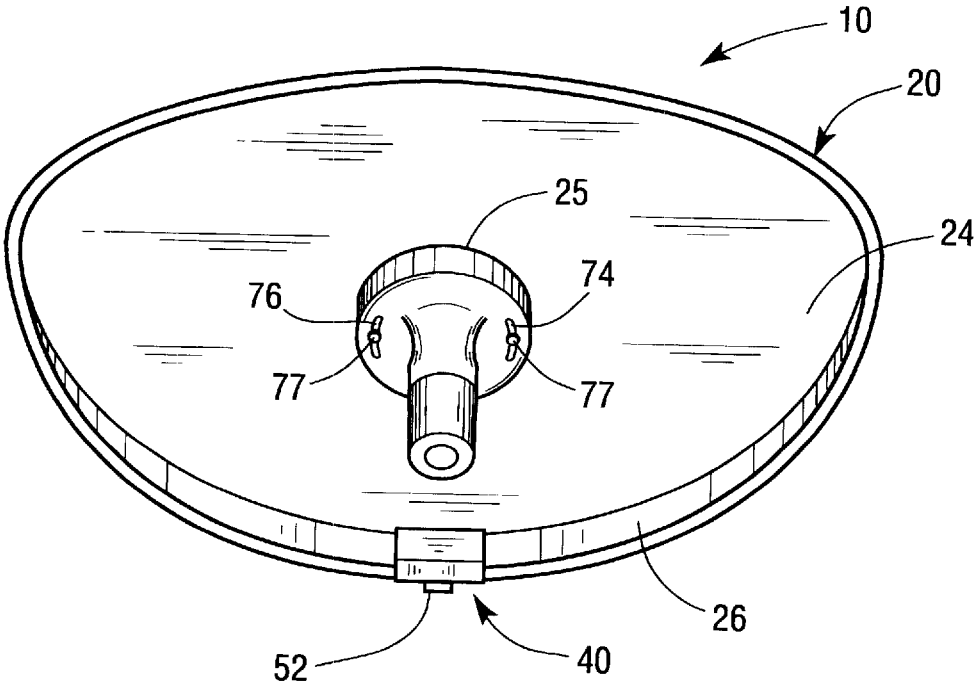
FIG. 2 is a rear view of the receiver of FIG. 1.

Referring now to the drawings for the purposes of illustrating embodiments of the invention only and not for the purposes of limiting the same, FIGS. 1–5 illustrate an antenna 10 that comprises a parabolic reflector 20, a feed support arm 40 and a reflector mounting arm 70. Reflector 20 may be fabricated from fiberglass-reinforced plastic (a "first material") utilizing conventional thermoset fiberglass compression or injection molding processes. In the alternative, the reflector may be manufactured from stamped metal (i.e., steel, aluminum, etc.).

Figure 3:
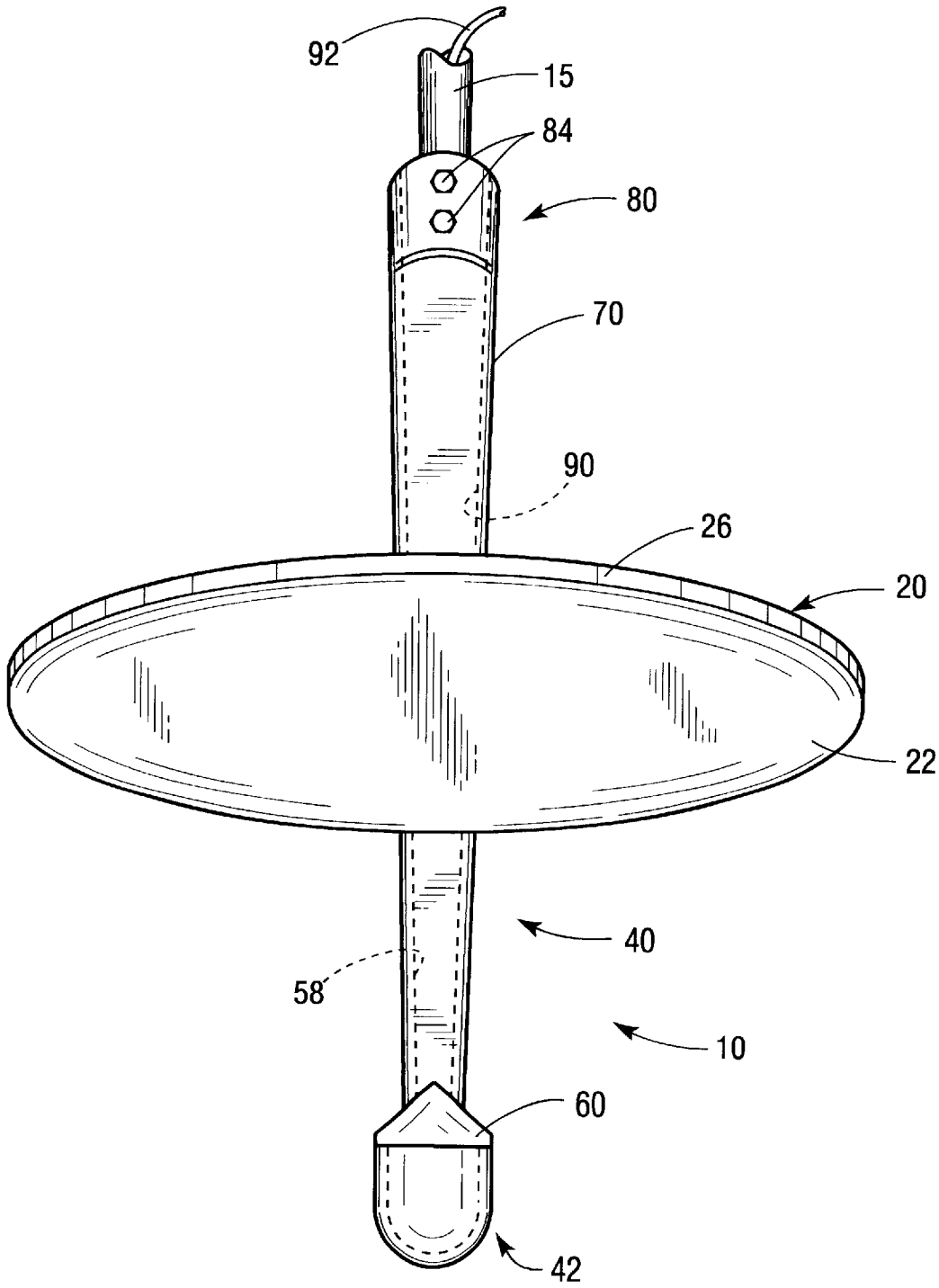
FIG. 3 is a top view of the receiver depicted in FIGS. 1 and 2.
Figure 5:
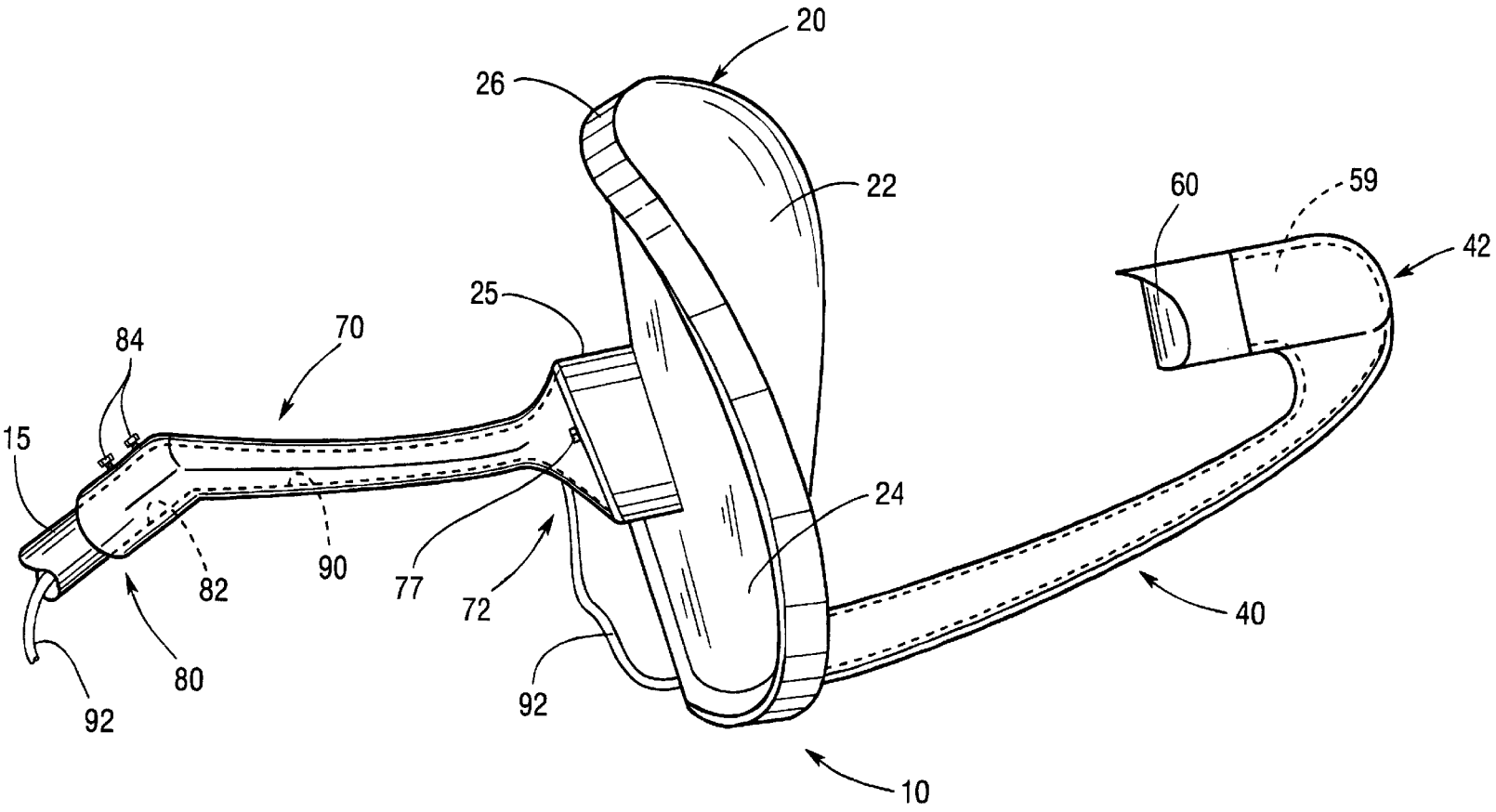
FIG. 5 is a left side view of the receiver depicted in FIGS. 1–4.
Figure 6:
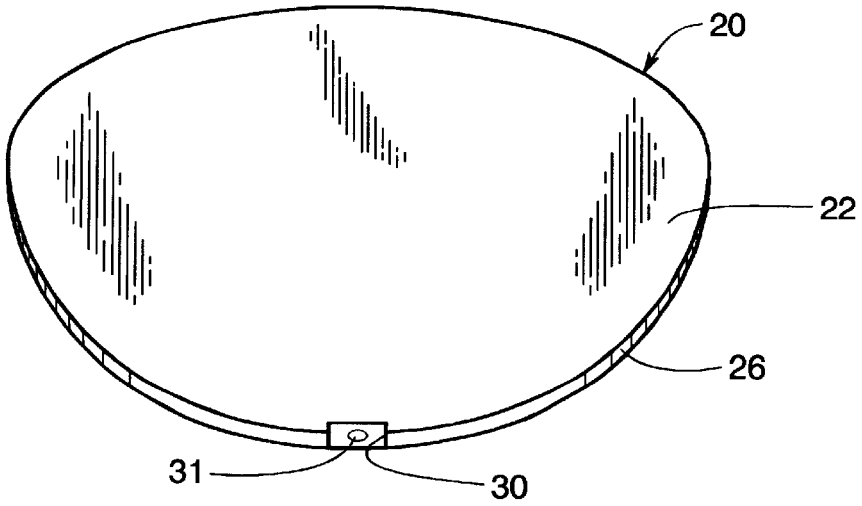
FIG. 6 is a front view of the reflector of the antenna depicted in FIGS. 1–5 with the support arm removed therefrom.

As can be seen in FIGS. 1, 3, and 5, the reflector 20 has a front surface 22 and a rear surface 24. A rim member 26 is molded around the perimeter of the reflector and protrudes from the rear surface 24 thereof. As shown in FIG. 6, a notch 30 ("point of attachment") is provided in the perimeter of the reflector 20 at the bottom thereof for attaching the forwardly extending portion of the support arm in the manner described in further detail below.

Figure 7:
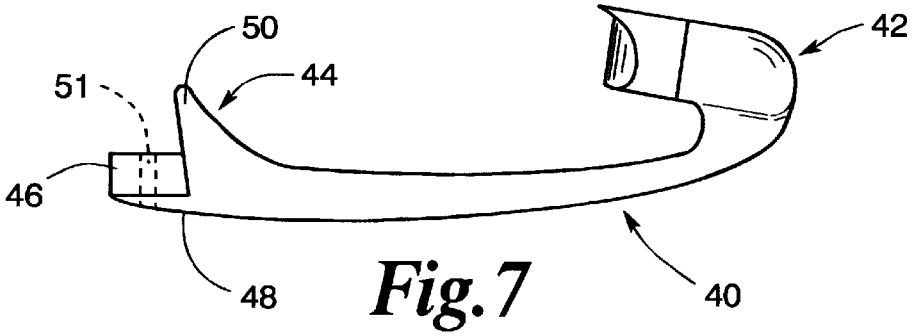
FIG. 7 is a side view of a support arm of one embodiment of the present invention.
Figure 8:
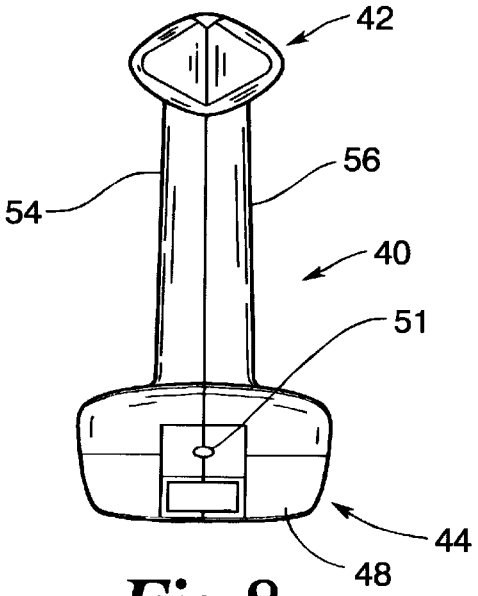
FIG. 8 is an end view of the support arm of FIG. 7.

The support arm 40 may be provided with the elongated shaped depicted in FIGS. 7 and 8. As can be seen in those Figures, the support arm 40 has a front portion 42 and a rear attachment portion 44. The rear attachment portion 44 includes and attachment block 46 that is sized to be received within the notch 30 in the reflector 20. In addition, the rear attachment portion 44 is provided with flanged portions (48, 50) that serve to cover the notch 30 ("point of attachment") in the reflector 20, assure stability of the support arm and provide an aesthetically pleasing point of attachment to the reflector 20. The attachment block 46 may be removably affixed to the reflector 20 by at least one screw 52 that extend through hole 51 in the attachment block 46 and a hole 31 in the rim 26. See FIGS. 2, 4, and 6.

Figure 4:
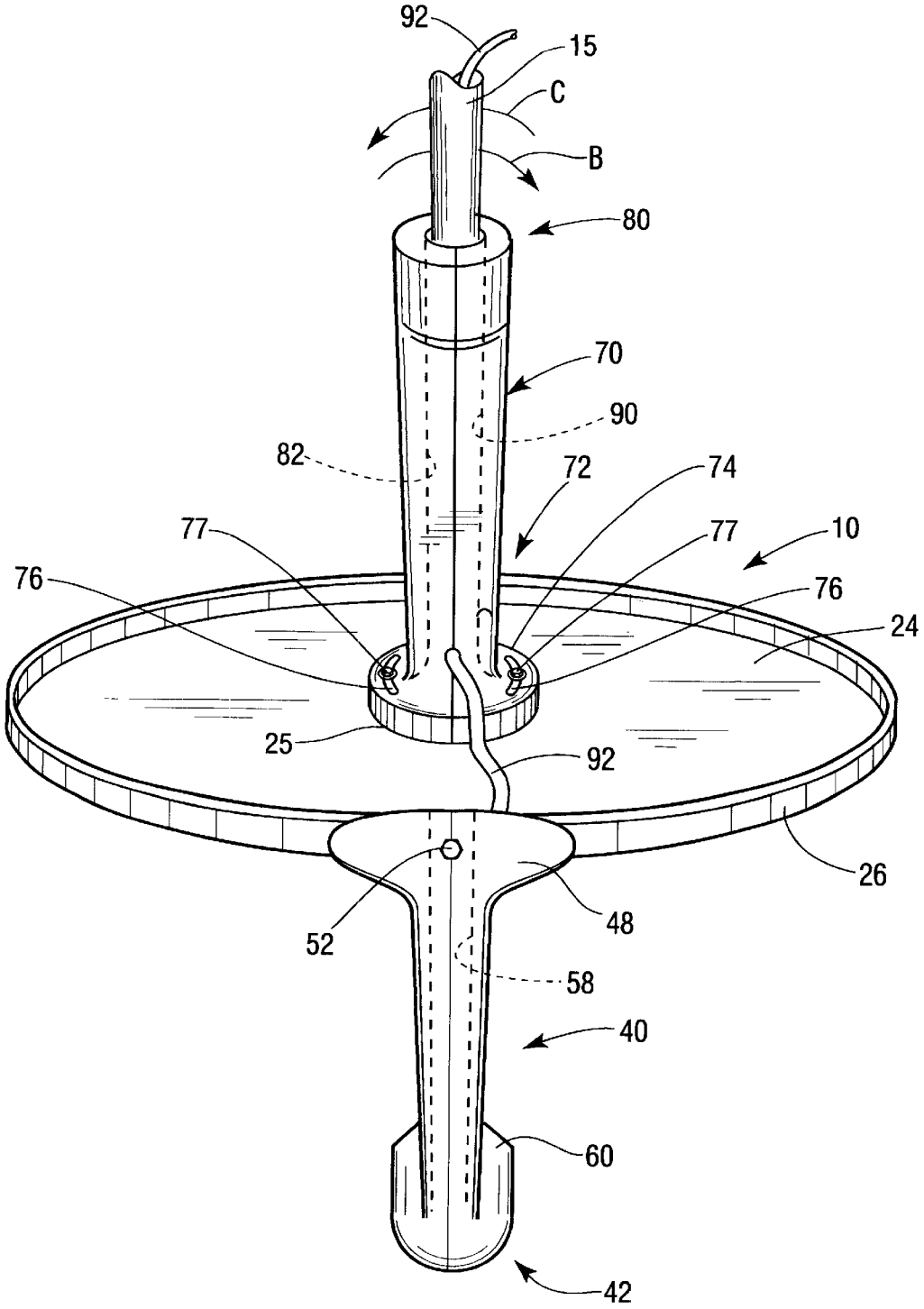
FIG. 4 is a bottom view of the receiver depicted in FIGS. 1–3.
Figure 9:
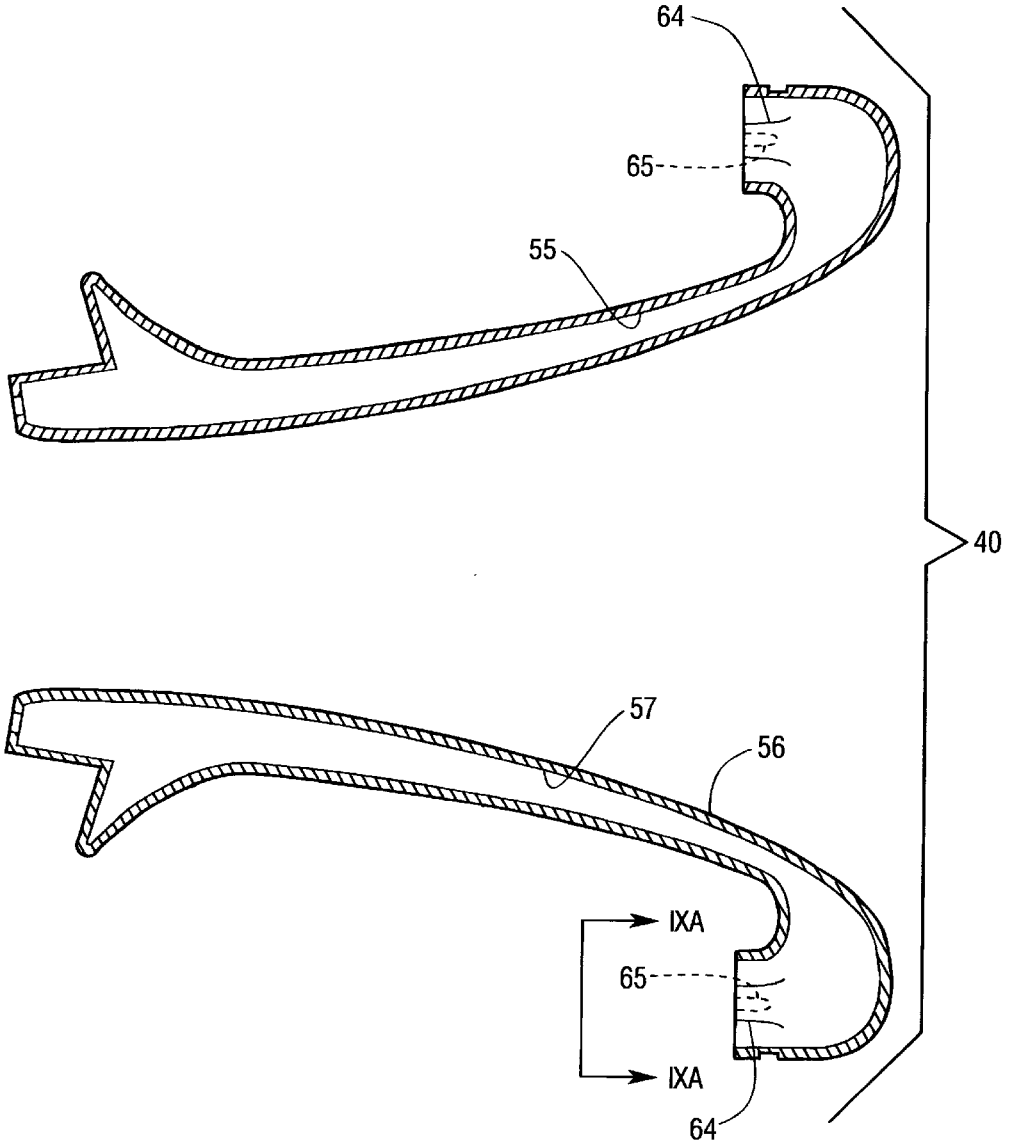
FIG. 9 is a side view of the pieces that comprise the support arm of FIGS. 7 and 8.
Figure 9A:
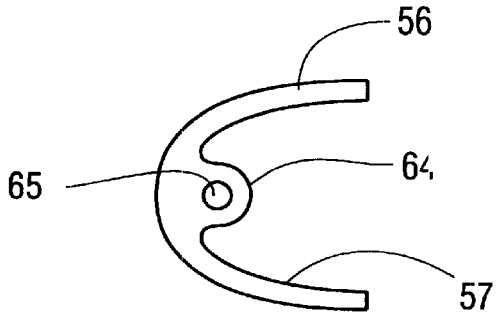
FIG. 9A is an end view of a portion of a support arm portion taken in the direction depicted by arrows IXA—IXA in FIG. 9.
Figure 9C:
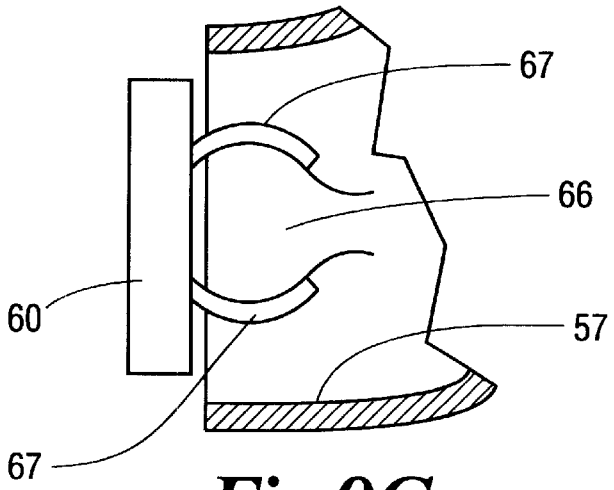
FIG. 9C is an end view of a portion of the support arm portion taken in the direction of arrows IXC—IXC in FIG. 9B with a feed/LNBF assembly attached thereto.
Figure 9D:
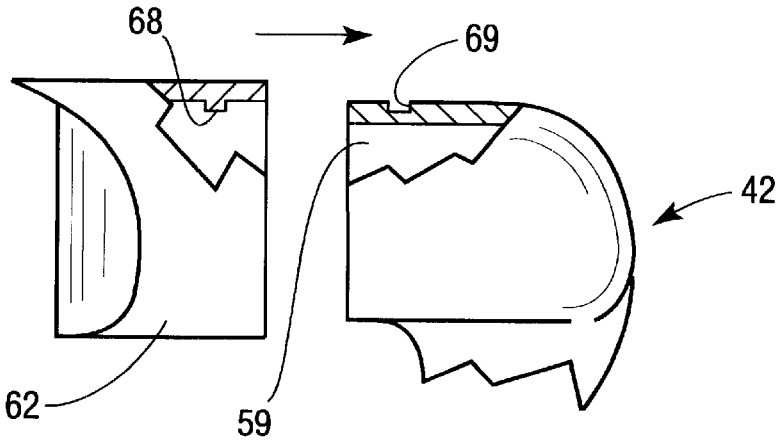
FIG. 9D is a partial view of the front portion of a support arm of the present invention and a raydome for attachment thereto.
Figure 9B:
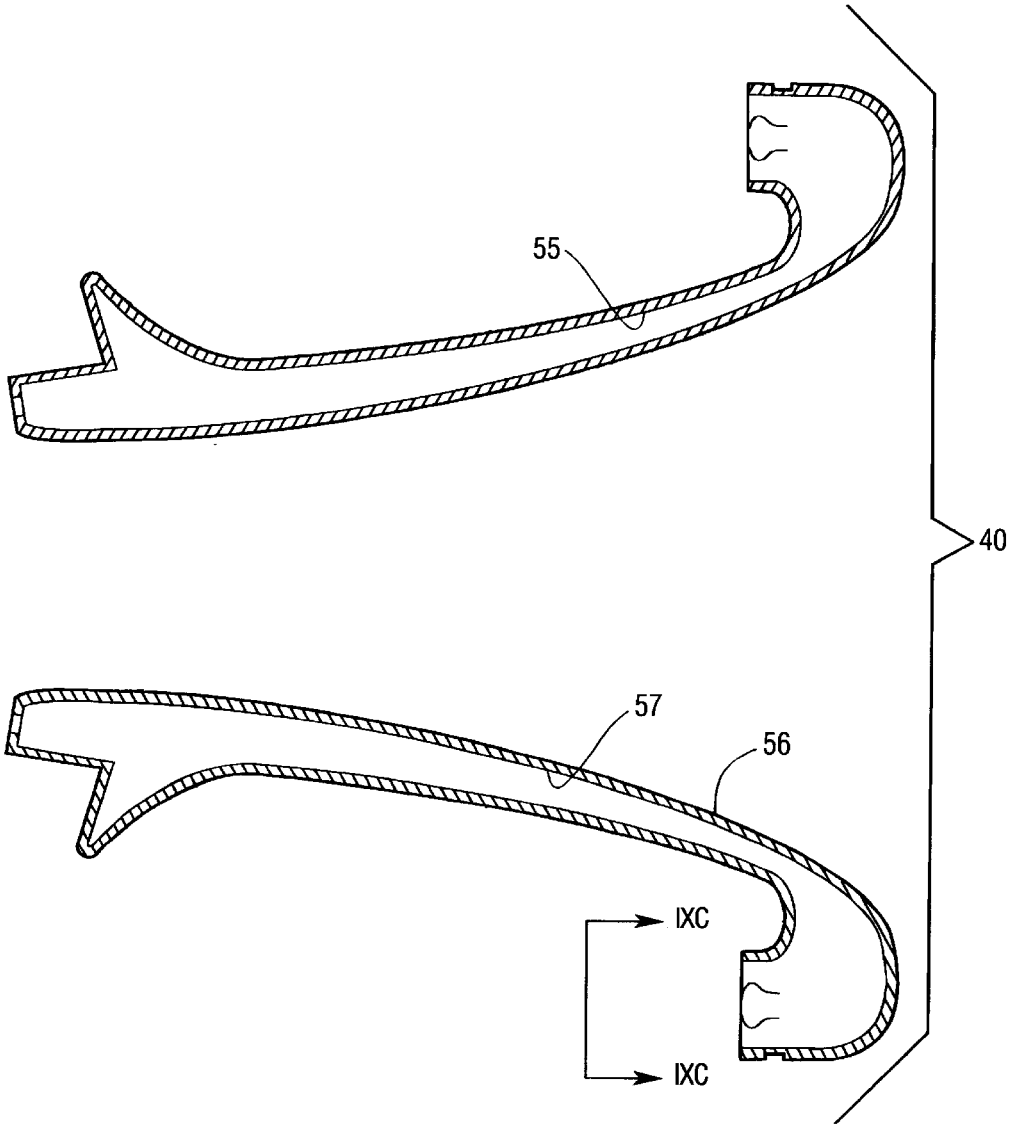
FIG. 9B is a side view of the pieces that comprise an alternate support arm of the present invention.

In one embodiment, the support arm 40 is molded in two pieces (54, 56) from thermoset fiberglass reinforced plastic of the type commonly employed by antenna manufacturers utilizing conventional compression or injection molding processes. As can be seen in FIG. 9, a first support arm portion 54 is formed with a centrally disposed first trough portion 55. Similarly, a second support arm portion 56 is formed with a second trough portion 57. When assembled together as shown in FIG. 4, the first trough 55 and the second trough 57 cooperate to form a first wireway 58 through the support arm 40. Support arm portions (54, 56) may be interconnected with appropriate adhesive, screws, snap fasteners etc. Thus, in this embodiment, the support arm 40 essentially comprises a hollow body. The first support arm portion 54 and the second support arm portion 56, when interconnected, further define a cavity 59 in the forward end thereof for receiving a conventional feed/LNBF assembly 60 therein. In one embodiment, the feed/LNBF assembly 60 is removably retained within cavity 59 by screws that attach to LNBF attachment posts 64 that are provided with a screw hole 65 therein. See FIGS. 9 and 9A. In an alternative embodiment, a forward LNBF support structure 66 is formed within the cavity 59. See FIGS. 9B and 9C. The feed/LNBF assembly is then removably retained within the cavity 59 by a pair of snap arms 67 attached to the feed LNBF/assembly 60. See FIG. 9C. Such feed/LNBF assemblies are known in the art and, therefore, the manufacture and operation of feed/LNBF assembly 60 will not be discussed herein.

In this embodiment, a raydome 62 that may be fabricated from plastic or other suitable material utilizing the above-mentioned manufacturing techniques is attached over the opening to the cavity 59 to conceal and protect the feed/LNBF assembly 60 and wire connections from the elements. More particularly and with reference to FIGS. 9 and 9D, the raydome 62 in this embodiment has an inwardly-protruding annular flange segment 68 formed on the inner surface thereof that is sized to snap into a corresponding annular groove segment 69 that is formed around the perimeter of the front portion 42 of the support arm 40. In the alternative, raydome 62 could be removably secured to the front portion 42 of the support arm 40 by screws or other appropriate fasteners.

The reflector mounting arm 70 of this embodiment may be fabricated from fiberglass reinforced plastic utilizing the same method employed to manufacture the support arm portions (54, 56) as was described above and includes an antenna attachment portion 72 and a mounting portion 80. The antenna attachment portion 72 may be provided with an attachment flange 74 that has two opposing arcuate attachment slots 76 therein. In one embodiment, an attachment boss 25 is integrally molded with the rear surface 24 of the antenna reflector 20 or is otherwise attached thereto by, adhesive, screws, welding, etc. The reflector mounting arm 70 may be attached to the attachment boss 25 by attachment screws 77 that extend through the arcuate slots 76 and are screwed into the reflector 20. See FIG. 4. Those of ordinary skill in the art will appreciate that the antenna reflector may 20 be rotated about axis A—A relative to the reflector mounting arm 70 by loosening the screws 77 and rotating the reflector. Such rotation of reflector is represented by arrows "B" and "C" in FIG. 4 and is employed to orient the antenna 10 at an appropriate skew orientation.

Figure 5A:
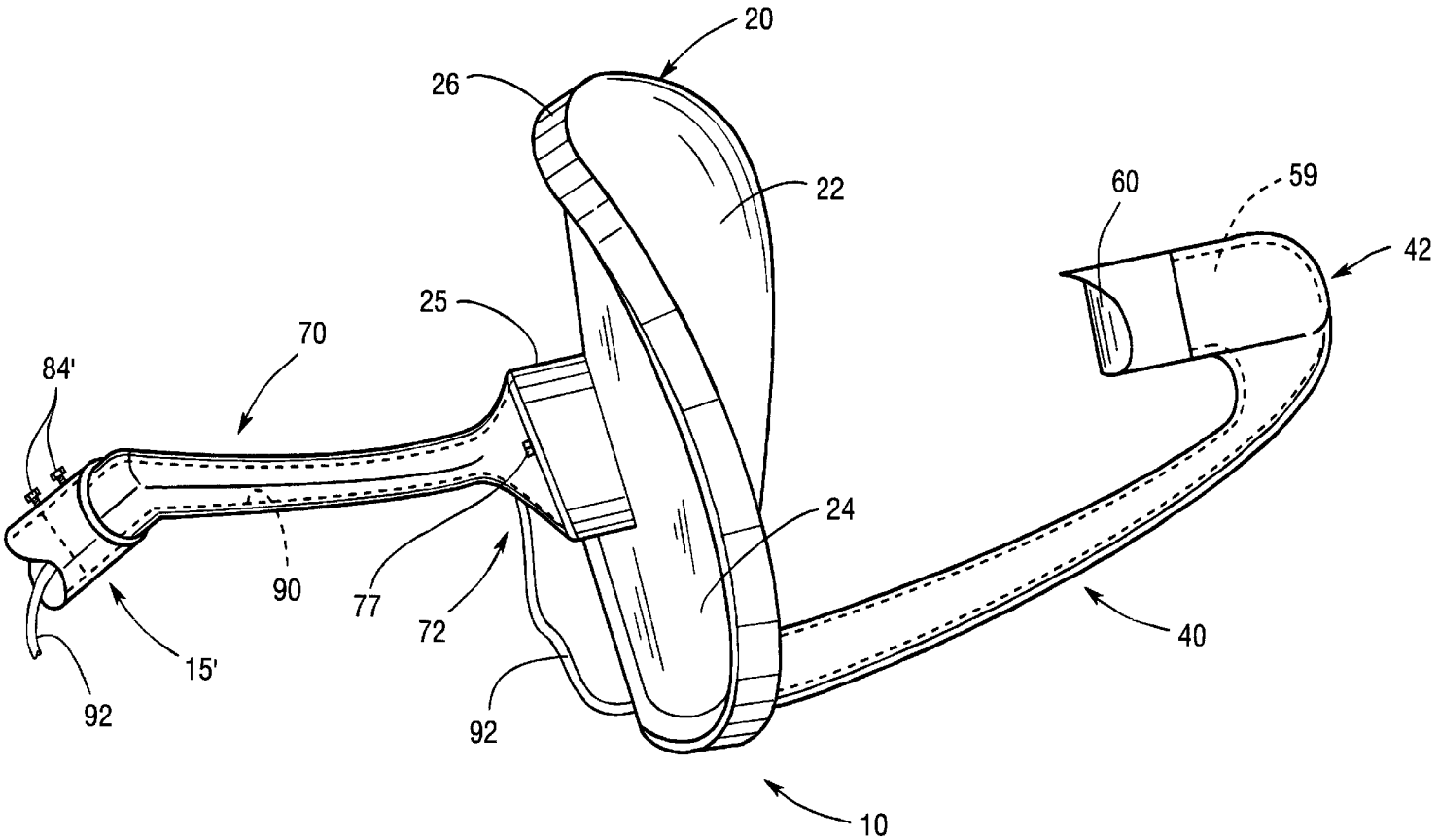
FIG. 5A is a left side view of an alternate embodiment of the present invention attached to a receiver.

In this embodiment, the mounting portion 80 of the reflector mounting arm 70 may be provided with a socket 82 for receiving a portion of a mounting mast 15 therein. The mounting mast 15 may be retained within the socket 82 by one or more setscrews 84. See FIG. 5. The other end of the mounting mast 15 may be supported in a mounting bracket 100 of the type disclosed in co-pending U.S. patent application Ser. No. 09/751,460, filed Dec. 29, 2000, entitled MOUNTING BRACKET the disclosure of which is hereby incorporated by reference. An alternate mounting arrangement is depicted in FIG. 5A. As can be seen in that Figure, the end 82 of the mounting arm 70 is received within a hollow mast portion 15' and retained therein by setscrews 84'.

Figure 10:
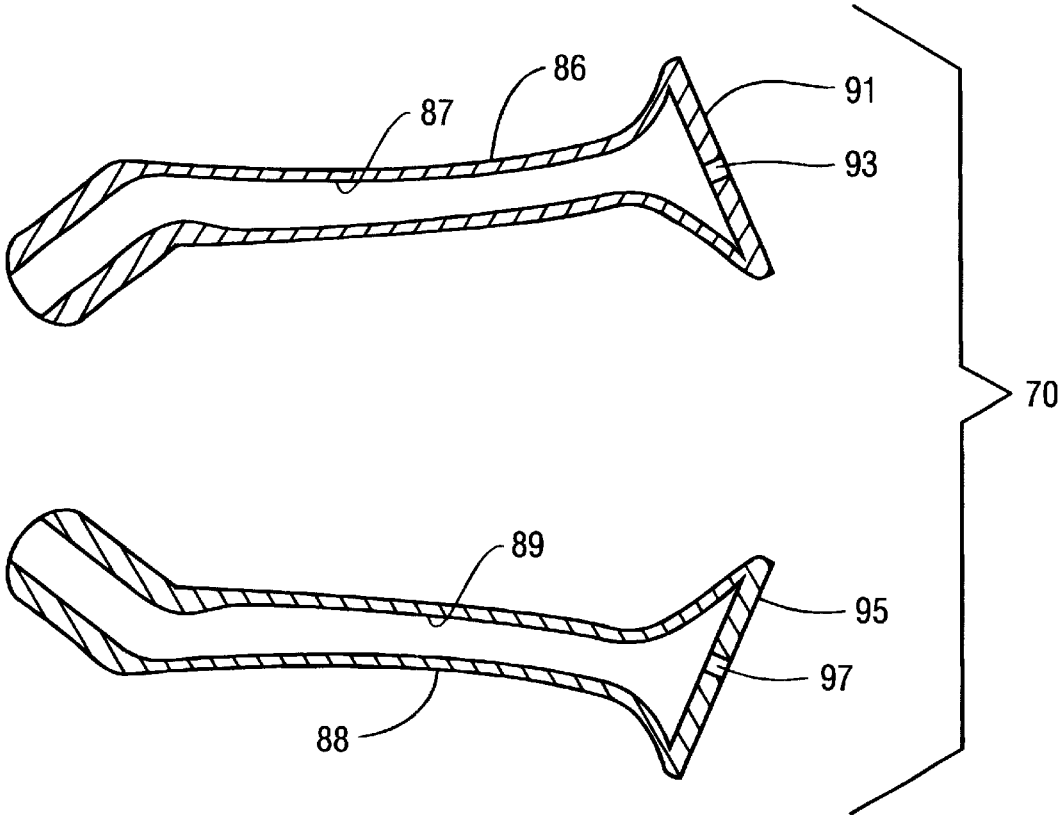
FIG. 10 is a side view of the pieces that comprise a mounting arm of the antenna depicted in FIGS. 1–5.
Figure 10A:
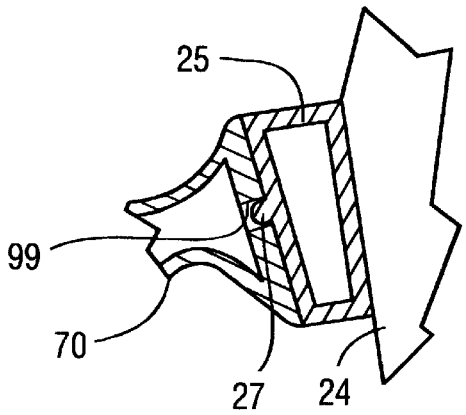
FIG. 10A is a partial side view of a reflector that has an attachment boss of the present invention and a mounting arm of an embodiment of the present invention attached thereto.

As can be seen in FIG. 10, the reflector mounting arm 70 may be fabricated from a first mounting arm portion 86 and a second mounting arm portion 88 that are interconnected by, for example, adhesive, snaps, screws, etc. The first mounting arm portion 86 is formed with a first mounting arm trough 87 and an end portion 91 that has a hole segment 93 therein. Similarly the second mounting arm portion 88 is formed with a second mounting arm trough 89 and an end portion 95 that has a hole segment 97 therein. When the first mounting arm portion 86 is attached to the second mounting arm portion 88, the first mounting arm trough 87 and the second mounting arm trough 89 form a second wireway 90 through the mounting arm 70 and the ends (91, 95) and hole segments (93, 97) form a pilot hole 99 that is adapted to be received on a locating pin 27 formed on the attachment boss 25. See FIG. 10A. Those of ordinary skill in the art will appreciate that the pin 27 serves to define the centerline for the reflector mounting arm 70 and enables the reflector mounting arm 70 to be pivoted therearound.

Figure 11:
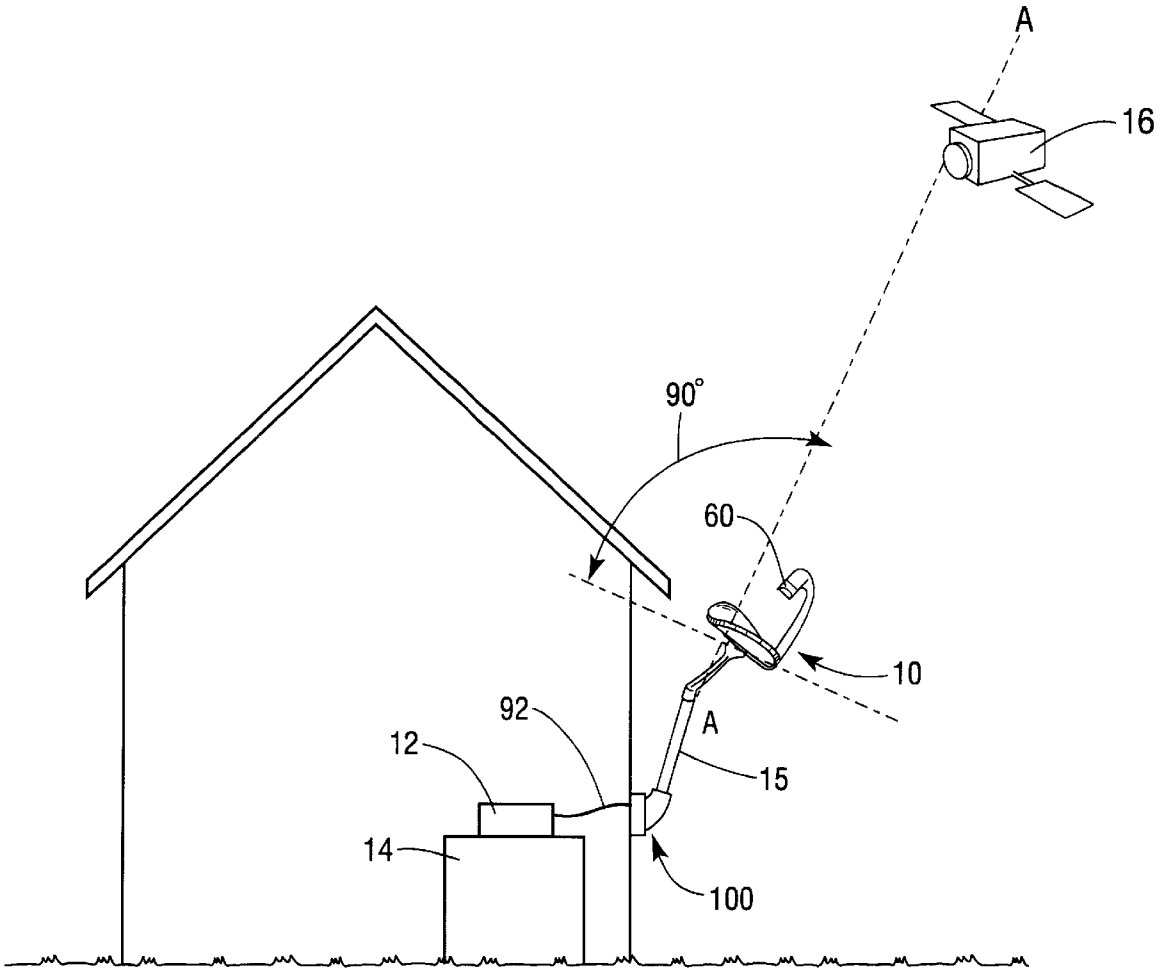
FIG. 11 is a is a graphical representation of the antenna of FIGS. 1–5 supported by a mounting bracket attached to a building and aligned to receive a signal from a satellite.

When the antenna 10 is assembled as shown in FIGS. 4 and 5, a cable 92 electrically couples the feed/LNBF assembly 60 to a set top box 12 that is attached to a television 14. See FIG. 11. Such set top boxes are known in the art and comprise an integrated receiver decoder for decoding the received broadcast signals from the antenna 10. During operation, the feed/LNBF assembly 60 converts the focused signals from a satellite 16 to an electrical current that is amplified and down converted in frequency. The amplified and down-converted signals are then conveyed via cable 92 to the set top box 12. The set top box 12 tunes the output signal to a carrier signal within a predetermined frequency range. A tuner/demodulator within the set top box 12 decodes the signal carrier into a digital data stream selected signal. Also a video/audio decoder is provided within the set top box 12 to decode the encrypted video signal. A conventional user interface on the television screen may be employed to assist the installer of the antenna 10 during the final alignment and "pointing" of the antenna 10.

In this embodiment, the cable 92 extends through the first wireway 58 in the feed support arm 40 and through the notch 30 in the reflector 20 and through the second wireway 90 in the reflector mounting arm 70. An exit hole (not shown) may be provided in the reflector mounting arm 70 adjacent the mounting end 80 to permit the cable 92 to exit the reflector mounting arm 70. In the alternative, if a hollow mast 15 is employed as shown in FIGS. 4 and 5, the cable 92 could extend through the second wireway 90 in the reflector mounting arm 70 and through the hollow mast 15. The cable 92 would then protrude out of the hollow mast 15 at the mounting bracket 100 or in the vicinity thereof, thereby concealing the cable 92 as far as possible to protect the cable and prevent it from detracting from the antenna's aesthetic appearance. The skilled artisan will readily appreciate that the mounting end 80 of the reflector mounting arm 70 may be constructed to accommodate a variety of other mounting brackets and devices for supporting an antenna.

Those of ordinary skill in the art will appreciate that the feed support arm and the reflector mounting arm may be fabricated in a variety of different manners. For example, the support arm 40 may be constructed such that it is solid and does not include a wireway for cable 92. Likewise the reflector mounting arm 70 may be fabricated such that it is solid and lacks a wireway for supporting cable 92. Another version of the present invention may include a hollow feed support arm 40 and a solid reflector mounting arm 70.

Figure 12:
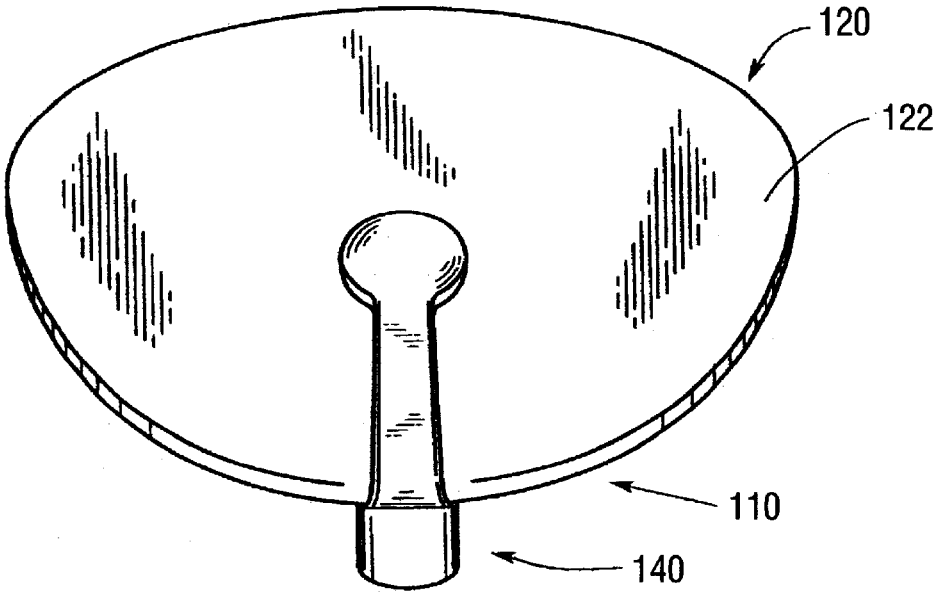
FIG. 12 is a front view of another reflector with another embodiment of the present invention attached thereto.
Figure 13:
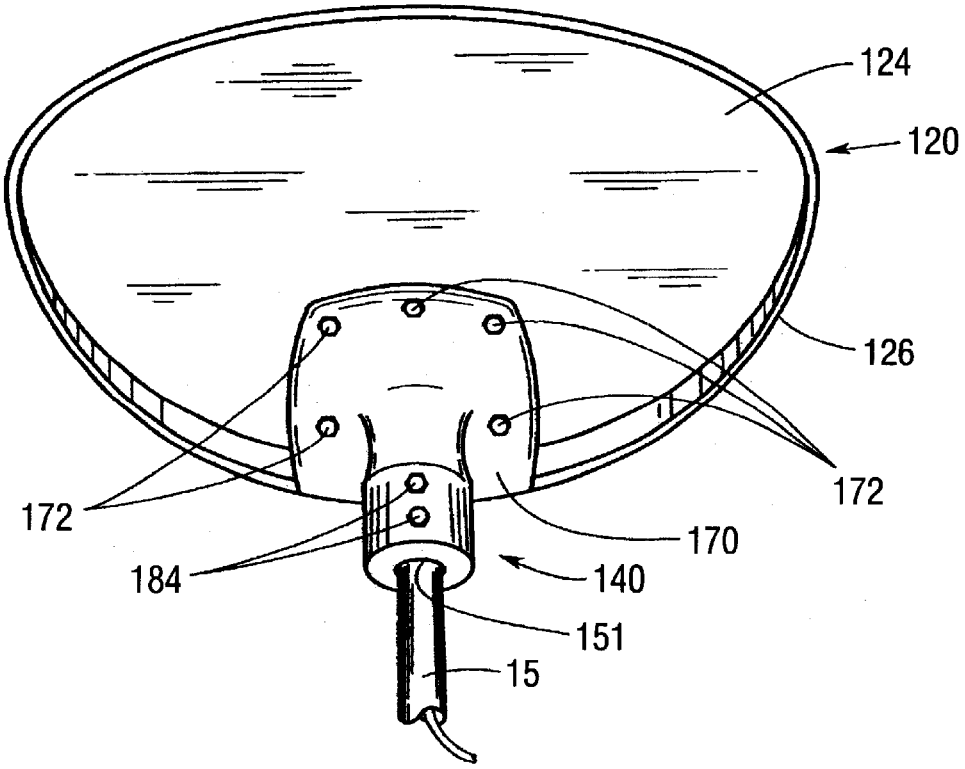
FIG. 13 is a rear view of the reflector of FIG. 12.
Figure 14:
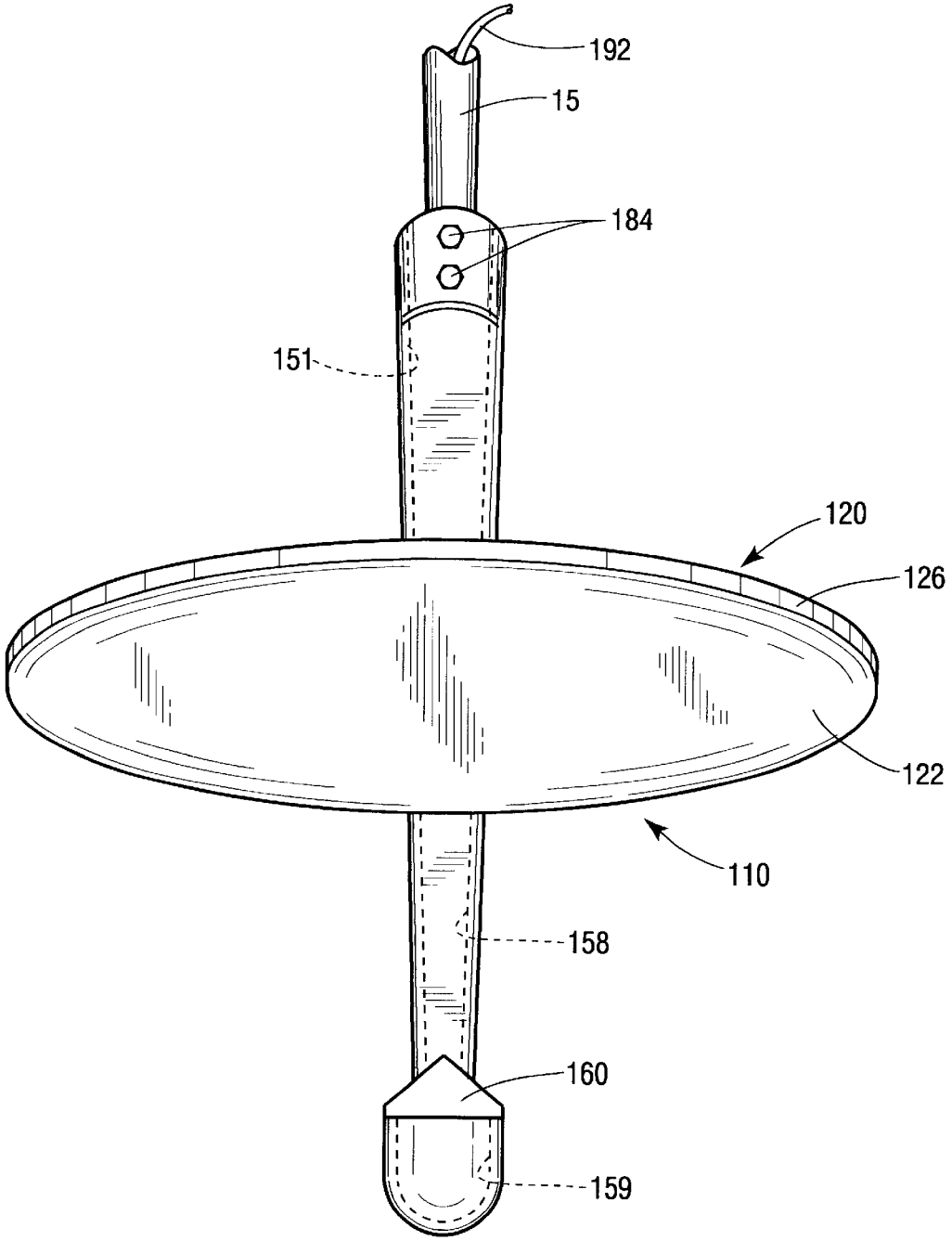
FIG. 14 is a top view of the reflector depicted in FIGS. 12 and 13.
Figure 15:
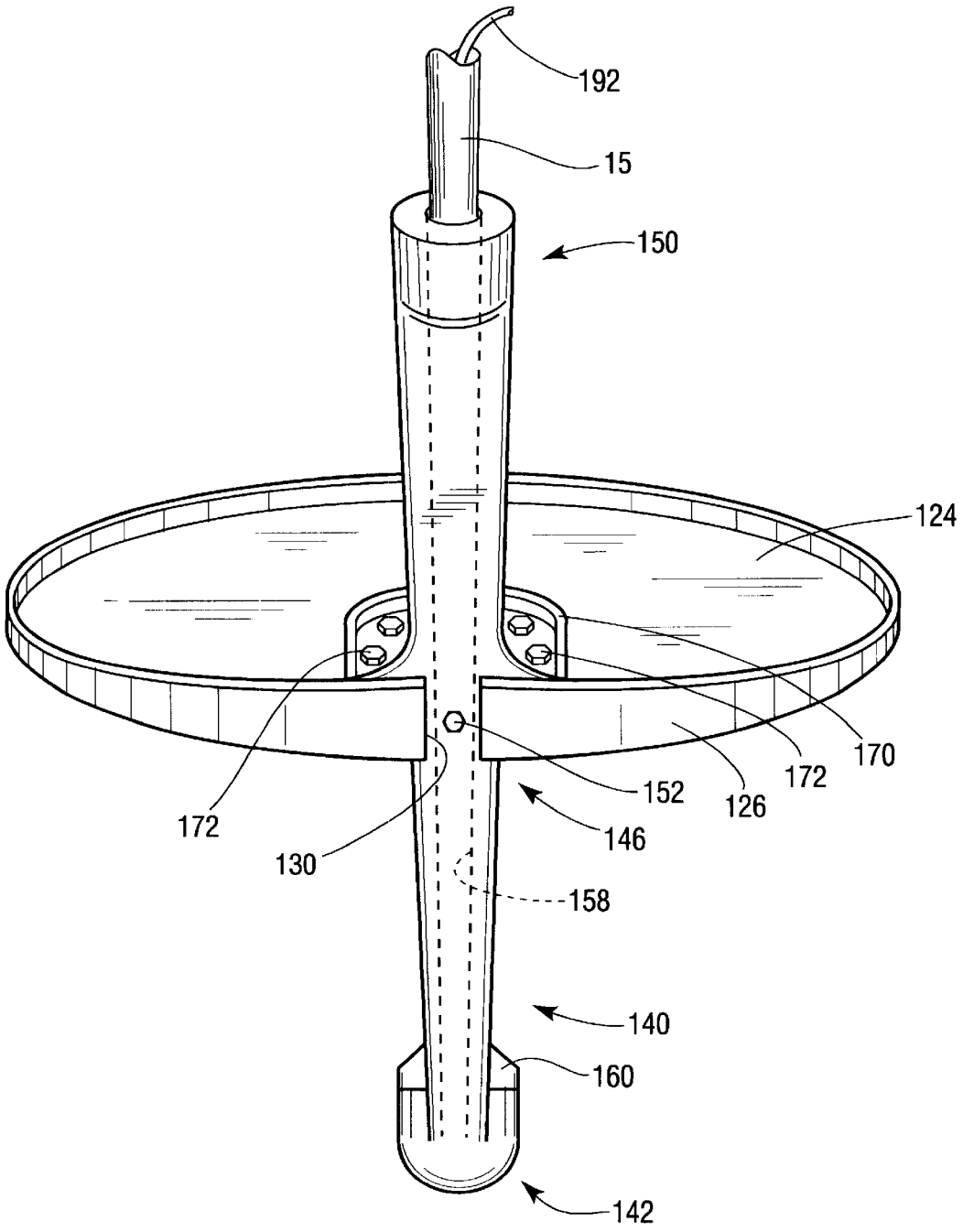
FIG. 15 is a bottom view of the reflector depicted in FIGS. 12–14.

FIGS. 12–17, illustrate another antenna embodiment of the present invention. As shown in FIG. 12, the antenna 110 comprises a parabolic reflector 120 and a support arm 140. Reflector 120 may be fabricated from fiberglass-reinforced plastic utilizing the manufacturing processes described above. In the alternative, the reflector 120 may be stamped or otherwise fabricated from metal such as steel, aluminum, etc. Reflector 120 has a front surface 122 and a rear surface 124. A rim member 126 is molded around the perimeter of the reflector 120 and protrudes from the front surface 122 thereof. As shown in FIG. 15, a notch 130 is provided in the perimeter of the reflector 120 at the bottom thereof for attaching the support arm 140 to the reflector 120.

Figure 17:
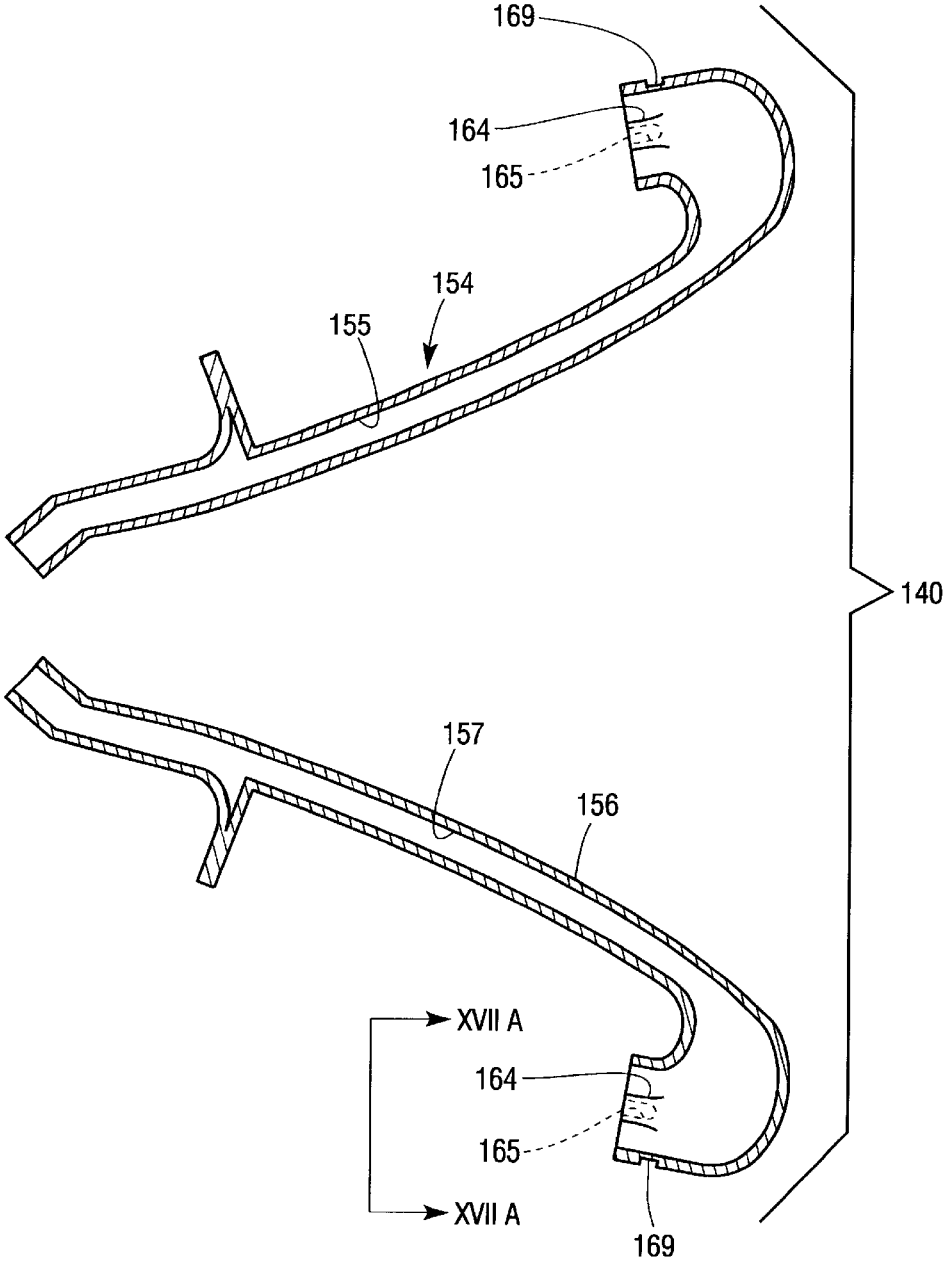
FIG. 17 is a is a side view of the pieces that comprise the support arm of the antenna depicted in FIGS. 12–16.
Figure 17A:
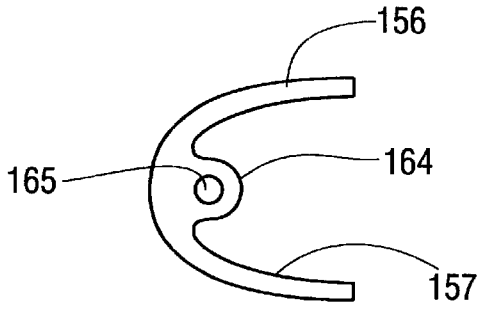
FIG. 17A is an end view of a portion of the support arm portion taken in the direction depicted by arrows XVIIA—XVIIA in FIG. 17.
Figure 17C:
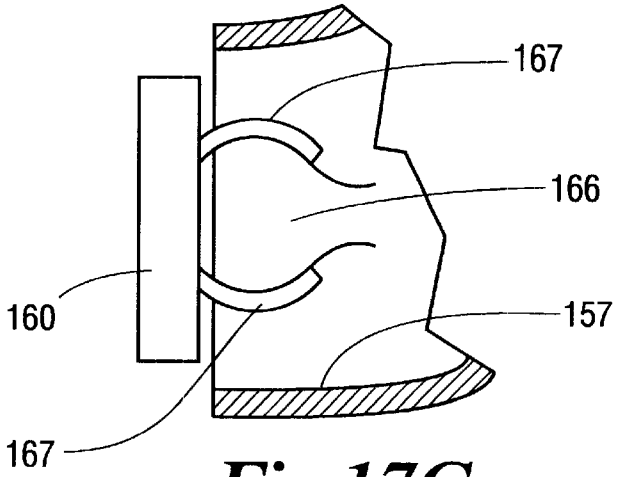
FIG. 17C is an end view of a portion of the support arm taken in the direction of arrows XVIIC—XVIIC in FIG. 17B with a feed/LNBF assembly attached thereto.
Figure 17D:
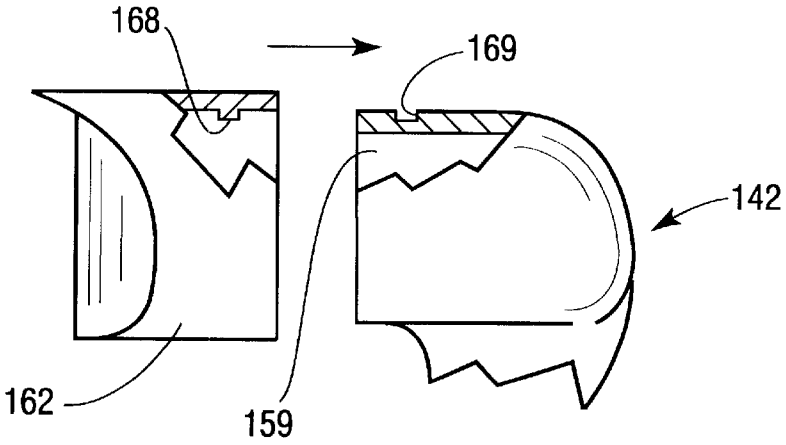
FIG. 17D is a partial view of the front portion of a support arm of the present invention and a raydome for attachment thereto.
Figure 17B:
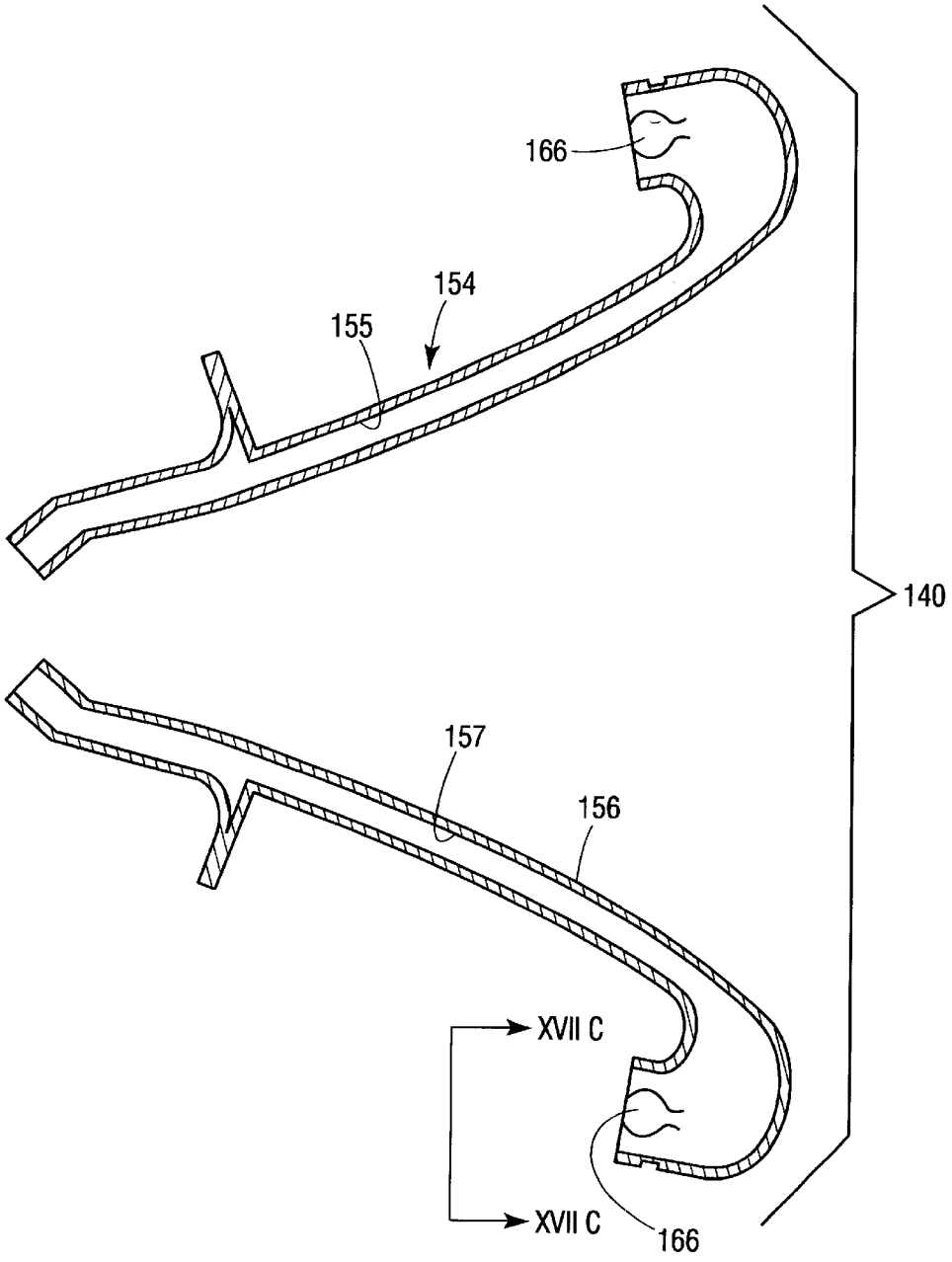
FIG. 17B is a side view of the pieces that comprise an alternate support arm of the present invention.
Figure 18:
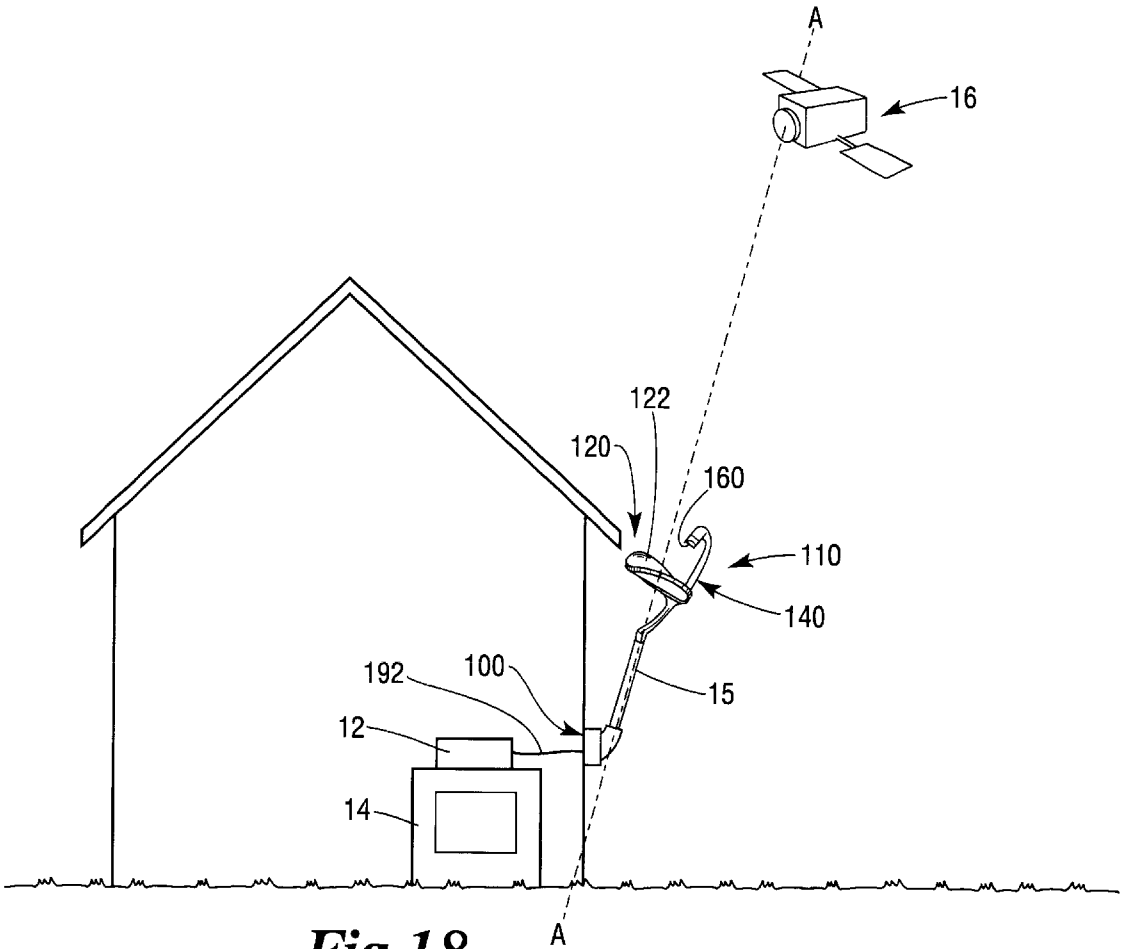
FIG. 18 is a is a graphical representation of the antenna of FIGS. 12–16 supported by a mounting bracket attached to a building and aligned to receive a signal from a satellite.

The support arm 140 has a forward end 142 for supporting a feed/LNBF assembly 160 therein, a central attachment portion 146 and a mounting end 150 for receiving a portion of a mounting mast 15 therein. In one embodiment, the support arm 140 is fabricated in two pieces (154, 156) from fiberglass-reinforced plastic utilizing the manufacturing methods described above. The primary support arm portion 154 is formed with an elongated primary trough 155 therein and the secondary support arm portion 156 is similarly formed with an elongated secondary trough 157. When the primary portion 154 is attached to the secondary portion 156 by, for example, adhesive, screws, clamps, snap fasteners, etc., the primary trough 155 and the secondary trough 157 combine to form a wireway 158. See FIG. 15. Troughs (155, 157) also cooperate to form a cavity 159 for receiving a feed/LNBF assembly 160 therein. In one embodiment, the feed/LNBF assembly 160 is removably retained within cavity 159 by screws that attach to LNBF attachment posts 164 that are provided with a screw hole 165 therein. See FIGS. 17 and 17A. In an alternative embodiment, a forward LNBF support structure 166 is formed within the cavity 159. See FIGS. 17B and 17C. The feed/LNBF assembly 160 is then removably retained within the cavity 159 by a pair of snap arms 167 attached to the feed LNBF/assembly 160. See FIG. 17C. The wireway 158 serves to support and conceal a cable 192 that is attached between the feed/LNBF assembly 160 and a set top box 114. See FIG. 17. The central attachment portion 146 may be provided with a hole therethrough for receiving an attachment screw 152 for attaching the support arm 140 to the bottom of the reflector 120. As can also be seen in FIGS. 13 and 15, the support arm 140 has a flanged portion 170 that is attached to the rear surface of the reflector 120 or to an attachment boss attached to the rear surface of the reflector by a plurality of attachment screws 172.

In this embodiment, a raydome 162 that may be fabricated from fiberglass reinforced plastic utilizing the above-mentioned manufacturing techniques is attached over the opening to the cavity 159 to conceal and protect the feed/LNBF assembly 160 and wire connections from the elements. More particularly and with reference to FIGS. 17 and 17D, the raydome 162 in this embodiment has an inwardly-protruding annular flange segment 168 formed on the inner surface thereof that is sized to snap into a corresponding annular groove segment 169 that is formed around the perimeter of the front portion 142 of the support arm 140. In the alternative, raydome 162 could be removably secured to the front portion 142 of the support arm 140 by screws or other appropriate fasteners.

Figure 16:
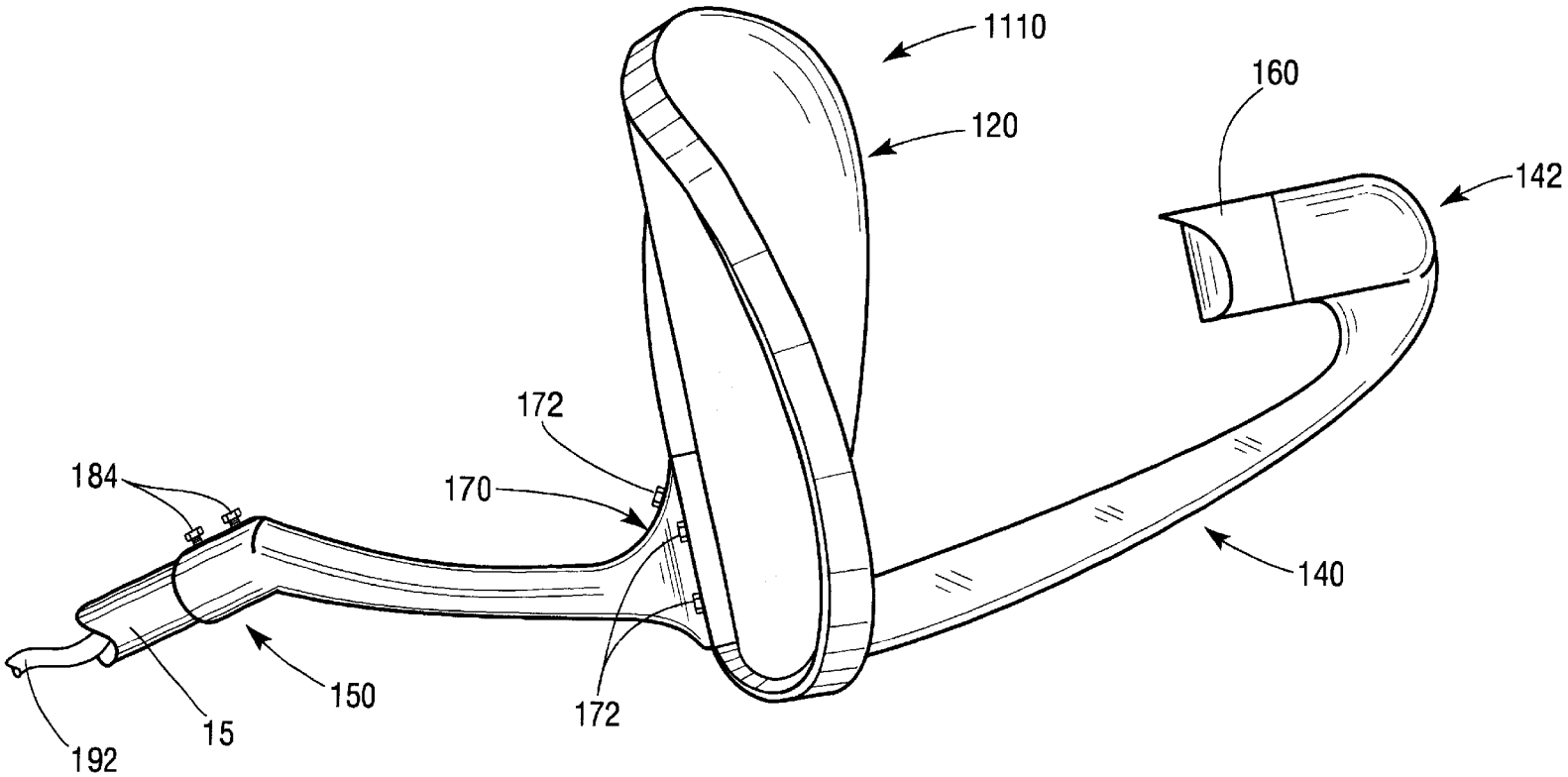
FIG. 16 is a left side view of the reflector depicted in FIGS. 12–15.
Figure 16A:
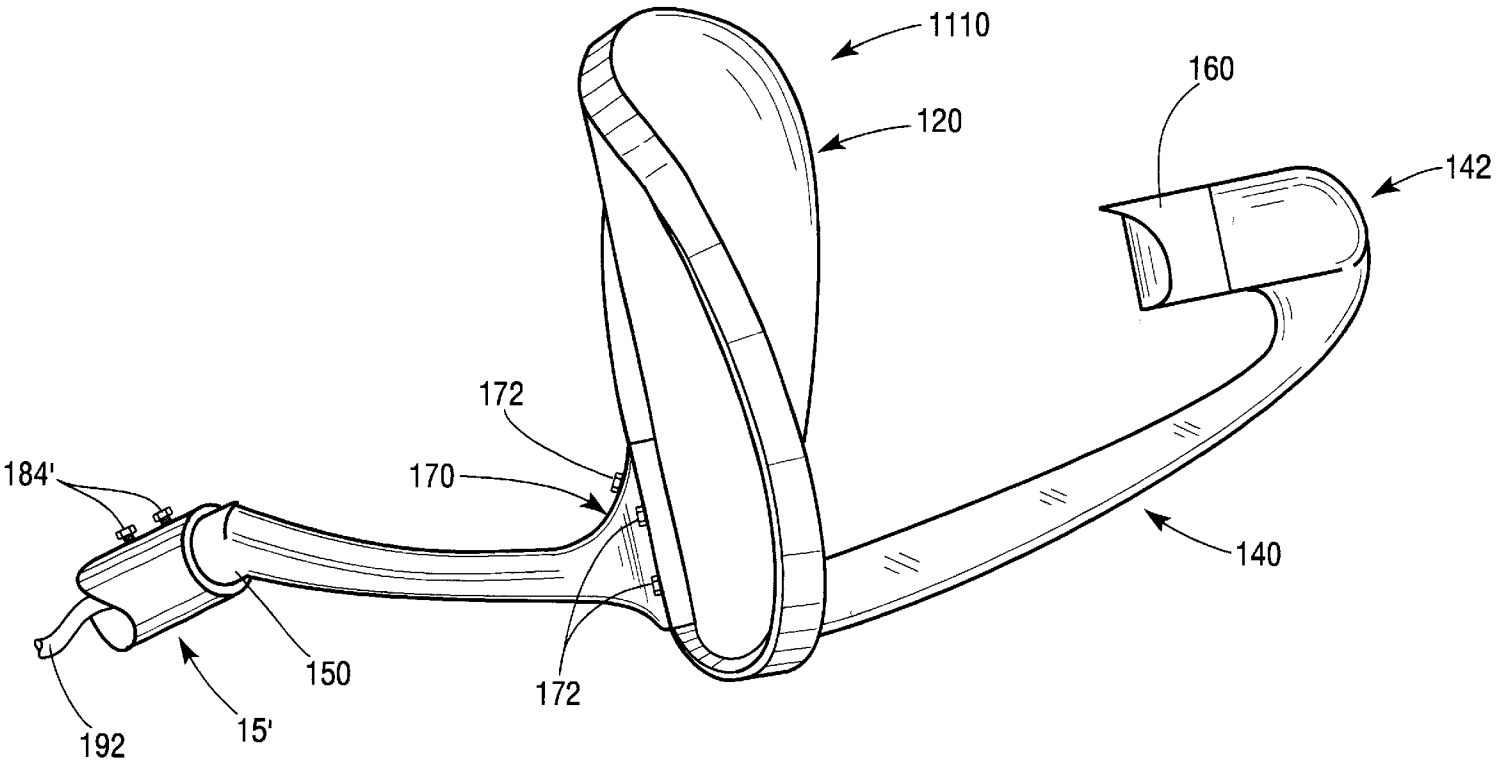
FIG. 16A is a left side view of an alternate embodiment of the present invention attached to a receiver.

The mounting portion 150 of the support arm 140 may be provided with a socket 151 for receiving a portion of a mounting mast 15 therein. The mounting mast 15 may be retained within the socket by one or more setscrews 184. The other end of the mounting mast 15 may be supported in a mounting bracket 100 of the type disclosed in the above-mentioned patent application, which has been incorporated herein by reference. An alternative mounting arrangement is depicted in FIG. 16A. However, mast may be supported in a myriad of other mounting brackets and arrangements. As can be seen in that Figure, the end 150 of the support arm 140 is received within a hollow mast portion 15' and retained therein by setscrews 184'. Those of ordinary skill in the art will appreciate that various changes in the details which have been herein described and illustrated in order to explain the nature of the invention may be made by the skilled artisan within the principle and scope of the invention as expressed in the appended claims.

What is claimed is:

1. A support arm arrangement for an antenna having a parabolic reflector that has a perimeter, a front surface and a rear surface, said support arm arrangement comprising:

a feed support arm having an attachment portion and a front portion, said attachment portion attached to the perimeter of the reflector, said feed support arm having a front flange extending across a portion of the front surface of the reflector to cover a point of attachment wherein said attachment portion is attached to the perimeter of the parabolic reflector; and a reflector mounting arm attached to said rear surface of said reflector.

2. The support arm arrangement of claim 1 wherein said attachment portion of said feed support arm has a bottom flange for covering said point of attachment.

3. The support arm arrangement of claim 1 wherein said feed support arm, comprises:

a first feed support arm portion having a first trough therein; and a second feed support arm portion having a second trough therein, said second feed support arm portion attached to said first feed support arm portion such that said first and second feed support arm portions form a first wireway through said feed support arm.

4. The support arm arrangement of claim 3 wherein said attachment portion of said feed support arm has a bottom flange for covering said point of attachment.

5. The support arm arrangement of claim 3 wherein said attachment portion of said feed support arm has a bottom flange for covering said point of attachment and providing rigidity to the feed support arm.

6. The support arm arrangement of claim 3 further comprising a feed/LNBF assembly supported in said front portion of said feed support arm.

7. The support arm arrangement of claim 6 wherein said feed/LNBF assembly is electronically coupled to a set top box by a cable that extends through said first wireway.

8. The support arm arrangement of claim 3 wherein said reflector mounting arm comprises:

a first reflector mounting arm portion having a first mounting arm trough therein; and a second reflector mounting arm portion having a second mounting arm trough therein, said second reflector mounting arm portion attached to said first reflector mounting arm portion such that said first mounting arm trough and said second mounting arm trough forms a second wireway through said reflector mounting arm.

9. The support arm arrangement of claim 8 wherein said reflector mounting arm is pivotally affixed to the rear surface of the parabolic reflector.

10. The support arm arrangement of claim 8 wherein said reflector mounting arm is pivotally attached to an attachment boss connected to the rear surface of the parabolic reflector.

11. The support arm structure of claim 3 wherein said first feed support arm and said second feed support arm are each molded from plastic material.

12. The support arm arrangement of claim 1 further comprising a feed/LNBF assembly supported in said front portion of said feed support arm.

13. The support arm arrangement of claim 12 further comprising:

a forward LNBF structure formed within said front portion of said feed support arm; and a pair of snap arms attached to said feed/LNBF assembly for retainingly engaging said forward LNBF structure to removably affix said feed/LNBF assembly to said front portion.

14. The support arm arrangement of claim 12 further comprising a radome attached to said front portion of said feed arm to enclose said feed/LNBF assembly within said front portion of said feed arm.

15. The support arm arrangement of claim 14 wherein said radome has an inwardly protruding annular flange portion thereon sized to be removably received within an annular groove portion in said front portion of said feed arm to removably affix said raydome to said front portion of said feed arm.

16. The support arm arrangement of claim 14 further comprising means for removably fastening said radome to said front portion of said feed arm.

17. The support arm arrangement of claim 16 wherein said means for removably fastening comprises removable fasteners.

18. The support arm arrangement of claim 1 wherein said reflector mounting arm comprises:

a first reflector mounting arm portion having a first mounting arm trough therein; and a second reflector mounting arm portion having a second mounting arm trough therein, said second reflector mounting arm portion attached to said first reflector mounting arm portion such that said first mounting arm trough and said second mounting arm trough forms a second wireway through said reflector mounting arm.

19. The support arm arrangement of claim 18 wherein said reflector mounting arm is pivotally affixed to the rear surface of the parabolic reflector.

20. The support arm arrangement of claim 18 wherein said reflector mounting arm is pivotally attached to an attachment boss connected to the rear surface of the parabolic reflector.

21. An antenna, comprising:

a molded parabolic reflector having a front surface, a rear surface, and a perimeter;

a feed support arm having an attachment end and being formed from a first feed support arm portion having a first support arm trough therein and a second feed support arm portion having a second support arm trough therein, said first and second feed support arm portions interconnected such that said first support arm trough and said second support arm trough forms a first wireway and wherein said attachment end of said feed support arm is attached to said reflector adjacent said perimeter thereof, said feed support arm having a front end and an attachment end, said attachment end having a front flange and a bottom flange for covering a point of attachment and providing rigidity to said feed support arm wherein said feed support arm is attached to said reflector;

a feed/LNBF assembly supported in said front end of said feed support arm;

a reflector mounting arm formed from a first reflector mounting arm portion having a first mounting arm trough and a second mounting arm portion having a second mounting arm trough, said second mounting arm portion interconnected to said first mounting arm portion such that said first and second mounting arm troughs form a second wireway, said reflector mounting arm pivotally affixed to said rear surface of said reflector; and a cable extending through said first and second wireways and connected to a set top box and said feed/LNBF assembly.

22. The antenna of claim 21 wherein said reflector mounting arm further has a socket formed therein for receiving a mast.

23. The antenna of claim 21 wherein said reflector mounting arm has an end portion sized to be received in a hollow mast.

24. The antenna of claim 21 further wherein said reflector mounting arm has a reflector attachment end for attachment to the reflector and wherein said antenna further comprises:

a locating pin protruding from a portion of the reflector; and a pilot hole in said reflector attachment end of said reflector mounting arm for receiving said locating pin therein to facilitate pivotal travel of said reflector about a centerline defined by said locating pin.

25. The antenna of claim 24 further comprising an attachment boss on said rear surface of said parabolic reflector and wherein said locating pin protrudes from said attachment boss.

26. The antenna of claim 25 wherein said reflector attachment end is attached to said attachment boss by removable fasteners.

27. A support arm assembly for an antenna having a parabolic reflector that has a perimeter, a front surface and a rear surface, said support arm assembly comprising a support arm attached to said perimeter of said reflector, said support arm having an integral front portion and an integral rear-mounting portion for mounting said antenna to a support structure.

28. The support arm assembly of claim 27 wherein said support arm further has an integral attachment flange for attachment to the rear surface of the reflector.

29. The support arm assembly of claim 27 further comprising a feed/LNBF assembly supported in said front portion of said support arm.

30. The support arm assembly of claim 27 wherein said support arm further comprises:

a primary support arm portion having a primary trough therein; and a secondary support arm portion having a secondary trough therein, said secondary support arm portion attached to said primary support arm portion such that said primary and secondary troughs form a wireway through said support arm.

31. The support arm assembly of claim 30 wherein said support arm further has an integral attachment flange for attachment to said rear surface of said reflector.

32. The support arm assembly of claim 30 further comprising a feed/LNBF assembly supported in said front portion of said support arm.

33. The support arm assembly of claim 32 wherein said feed/LNBF assembly is electronically coupled to a set top box by a cable that extends through said wireway.

34. An antenna comprising:

a parabolic reflector having a perimeter, a front surface and a rear surface; and a hollow support arm attached to said perimeter of said reflector, said hollow support arm further having an integral rear flange for attachment to said rear surface of said reflector, said hollow support arm having an integral front portion and an integral rear mounting portion;

a feed/LNBF assembly supported in said front portion of said hollow support arm; and a cable extending through said hollow support arm and connected to a set top box and said feed/LNBF assembly.

35. The antenna of claim 34 wherein said integral rear mounting portion has a socket formed therein for receiving a mast.

36. The antenna of claim 34 wherein said integral rear mounting portion is sized to be received in a hollow mast.

37. A method of manufacturing an antenna, comprising:

molding a parabolic reflector from a first material, the parabolic reflector having a front surface, a rear surface, and a perimeter;

molding a hollow feed support arm from the first material, the hollow feed support arm having a front end and a rear attachment end;

affixing the rear attachment end of the hollow feed support arm to reflector at its perimeter thereof;

molding a hollow reflector mounting arm;

affixing a portion of the hollow reflector mounting arm to the rear surface of the reflector;

supporting a feed/LNBF assembly in the front end of the feed support arm; and electrically coupling the feed/LNBF assembly to a set top box.

38. The method of claim 37 further comprising concealing the feed/LNBF assembly with a radome attached to the front end of the feed support arm.

39. The method of claim 37 wherein said molding a hollow feed support arm comprises:

molding a first feed support arm portion having a first trough therein;

molding a second feed support arm portion having a second trough therein; and interconnecting said first and second feed support arm portions such that the first and second troughs form a first wireway.

40. The method of claim 39 wherein said molding a hollow reflector mounting arm comprises:

molding a first reflector mounting arm portion having a first mounting arm trough therein;

molding a second reflector mounting arm portion having a second mounting arm trough therein; and interconnecting the first and second reflector mounting arm portions such that the first mounting arm trough and the second mounting arm trough form a second wireway through the reflector mounting arm.

41. The method of claim 40 wherein said electronically coupling comprises:

supporting portions of a cable in the first and second wireways; and attaching one end of the cable to the feed/LNBF assembly and another end of the cable to the set top box.

42. The method of claim 37 wherein said molding a hollow mounting arm comprises:

molding a first reflector mounting arm portion having a first mounting arm trough therein;

molding a second reflector mounting arm portion having a second mounting arm trough therein; and interconnecting the first and second reflector mounting arm portions such that the first mounting arm trough and the second mounting arm trough form a second wireway through the reflector mounting arm.

* * * * *